US009816337B2

(12) United States Patent
Zastresek et al.

(10) Patent No.: US 9,816,337 B2
(45) Date of Patent: Nov. 14, 2017

(54) FULL CLOSURE CORE CATCHER

(75) Inventors: Jiri Zastresek, Houston, TX (US); Rick Mecham, Spring, TX (US)

(73) Assignee: National Oilwell Varco, L.P., Houston, TX (US)

( * ) Notice: Subject to any disclaimer, the term of this patent is extended or adjusted under 35 U.S.C. 154(b) by 1579 days.

(21) Appl. No.: 13/271,611

(22) Filed: Oct. 12, 2011

(65) Prior Publication Data

US 2013/0092442 A1 Apr. 18, 2013

(51) Int. Cl.
*E21B 25/14* (2006.01)

(52) U.S. Cl.
CPC ..... *E21B 25/14* (2013.01)

(58) Field of Classification Search
CPC . E05D 1/04; E21B 25/00; E21B 25/10; E21B 25/14
USPC ... 175/20, 58, 244, 251, 245, 248, 249, 252, 175/403; 16/355, 267–269
See application file for complete search history.

(56) References Cited

U.S. PATENT DOCUMENTS 600,318 A 3/1898 L. L. Pletcher
2,043,726 A 6/1936 Bangs
4,605,075 A 8/1986 Radford et al.
4,606,416 A * 8/1986 Knighton et al. ..... 175/58
4,607,710 A 8/1986 Radford
5,253,720 A 10/1993 Radford et al.
2005/0034273 A1* 2/2005 Roy ..... 16/254

OTHER PUBLICATIONS

Australian Examination Report dated May 15, 2014 for corresponding Australian Application No. 2012216819 (3 pgs.).
Canadian Office Action dated Apr. 17, 2014 for corresponding Canadian Application No. 2,792,205 (4 pgs.).

* cited by examiner

*Primary Examiner* — George Gray
(74) *Attorney, Agent, or Firm* — Derek V. Forinash; Porter Hedges LLP

(57) ABSTRACT

A core catcher includes a housing having an inner wall that defines an axial bore through the housing. A retention member is disposed within the housing and is coupled to a first hinge tab that defines a first hinge barrel with the inner wall of the housing. A first closure member has a slot that is engaged with the first hinge tab and a pivot edge that is at least partially disposed within the first hinge barrel. In an open position, the first closure member is disposed in an annulus between a sleeve that is slidably disposed within the housing and the housing. In a closed position the first closure member is disposed at least partially across the axial bore of the housing.

23 Claims, 7 Drawing Sheets

FULL CLOSURE CORE CATCHER

CROSS-REFERENCE TO RELATED APPLICATIONS

None

BACKGROUND

This disclosure relates generally to methods and apparatus for acquiring and analyzing cores from subterranean formations. More particularly, this disclosure relates to methods and apparatus for retaining a core within a coring tool.

Formation coring is a well-known process for obtaining a sample of a subterranean formation for analysis. In conventional coring operations, a specialized coring tool is used to obtain a cylindrical sample of material, or "core," from the formation and retain that core within a core barrel so that the core can be brought to the surface. Once at the surface, the core can be analyzed to reveal formation data such as permeability, porosity, and other formation properties that provide information as to the type of formation being drilled and/or the types of fluids contained within the formation.

Conventional coring tools include a coring bit that cuts a cylindrical core from the formation. The coring bit is coupled to a barrel assembly that receives the core once it is drilled and retains the core as it is brought to the surface. Many conventional coring tools include a core catcher that operates to help retain the core within the barrel assembly once it is drilled. Many different types of core catchers have been used including wedge systems that use friction and interference fits to retain the core and valve systems that form a barrier to retain the core. One type of valve core catcher is a clamshell catcher that utilizes opposing clamshell halves that rotate inwardly to form a barrier that retains the core in a barrel assembly.

In conventional clamshell catcher systems, each opposing clamshell half has a small tab that is rotatably coupled to the assembly by a hinge pin. Once activated, the opposing clamshell halves rotate about the hinge pins until the halves contact each other to form a barrier that closes the bottom of the barrel assembly. Many conventional clamshell catcher systems include a base ring that provides a location for the mounting of the hinge pins and supports the closed clamshell halves. Due to space limitations, in conventional clamshell catcher systems, the shape of the clamshell halves is such that portions of the clamshells do not contact the base ring when closed.

Because the clamshell halves do not fully contact the base ring there can be gaps between the clamshell halves and the base ring that allow unconsolidated formation materials, such as gravel or sand, to be lost. Further, under certain loading conditions, the hinge pin and/or hinge tab can yield and allow the clamshell halves be pushed through the base ring, which can result in loss of the core.

Thus, there is a continuing need in the art for methods and apparatus for retaining cores that overcome these and other limitations of the prior art.

BRIEF SUMMARY OF THE DISCLOSURE

A core catcher includes a housing having an inner wall that defines an axial bore through the housing. A retention member is disposed within the housing and is coupled to a first hinge tab that defines a first hinge barrel with the inner wall of the housing. A first closure member has a slot that is engaged with the first hinge tab and a pivot edge that is at least partially disposed within the first hinge barrel. In an open position, the first closure member is disposed in an annulus between a sleeve that is slidably disposed within the housing and the housing. In a closed position the first closure member is disposed at least partially across the axial bore of the housing.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
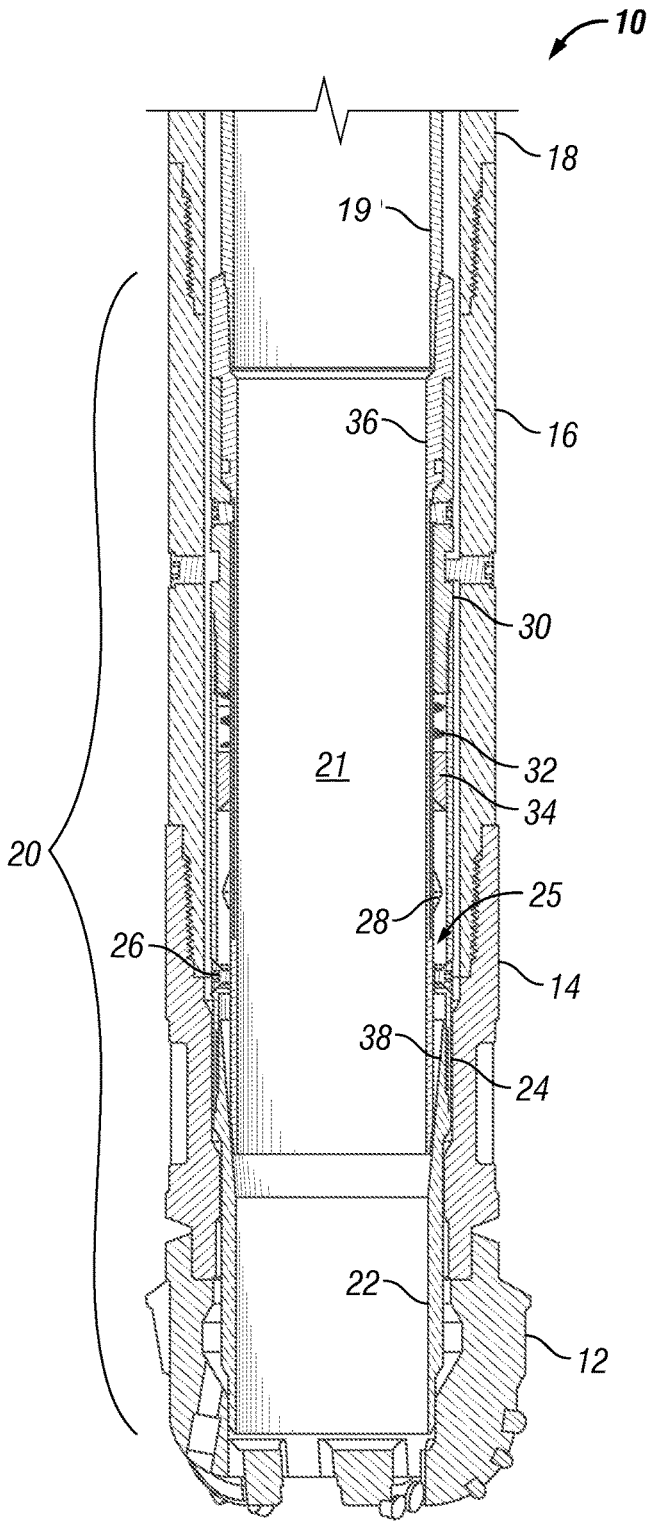
FIG. 1 is a cross sectional view of a coring tool having a core catcher assembly.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure. The terms "upper" and "lower" used herein are relative to the illustrated perspective and are able to be changed without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Referring initially to FIG. 1, a coring tool 10 includes a coring bit 12 coupled to an outer barrel 18 by a shank 14 and a core catcher sub 16. A core catcher assembly 20 is disposed within the coring tool 10 and is coupled to an inner barrel 19. In operation, the coring tool 10 is disposed within a wellbore and the coring bit 12 is rotated to extract a core from the formation. As the coring tool 10 is advanced through the formation, the core moves through the core catcher assembly 20 and into inner barrel 19. Once the desired length of core is drilled, a flow management assembly (not shown) is used to activate the core catcher assembly 20. When activated, the core catcher assembly 20 retains the core within the coring tool 10 as the tool is retrieved to the surface.

The core catcher assembly 20 includes a body formed by an inner shoe 22, a lower housing 24, and an upper housing 30 that defines an axial bore 21 that is substantially aligned with the center axis of the inner barrel 19. One or more closure members 28 are provided as a primary core catcher mechanism that operates to form a barrier across the axial bore 21 through the core catcher assembly 20. The core catcher assembly 20 can also include and a secondary core catcher mechanism 38 that operates to engage a core within the axial bore 21 and prevent axial movement of the core relative to the coring tool 10. An inner sleeve 36 is slidably disposed within the axial bore 21 of the core catcher assembly 20 and acts to hold both the primary 25 and secondary 38 core catchers in their open positions until the core catcher assembly 20 is activated.

Figure 2:
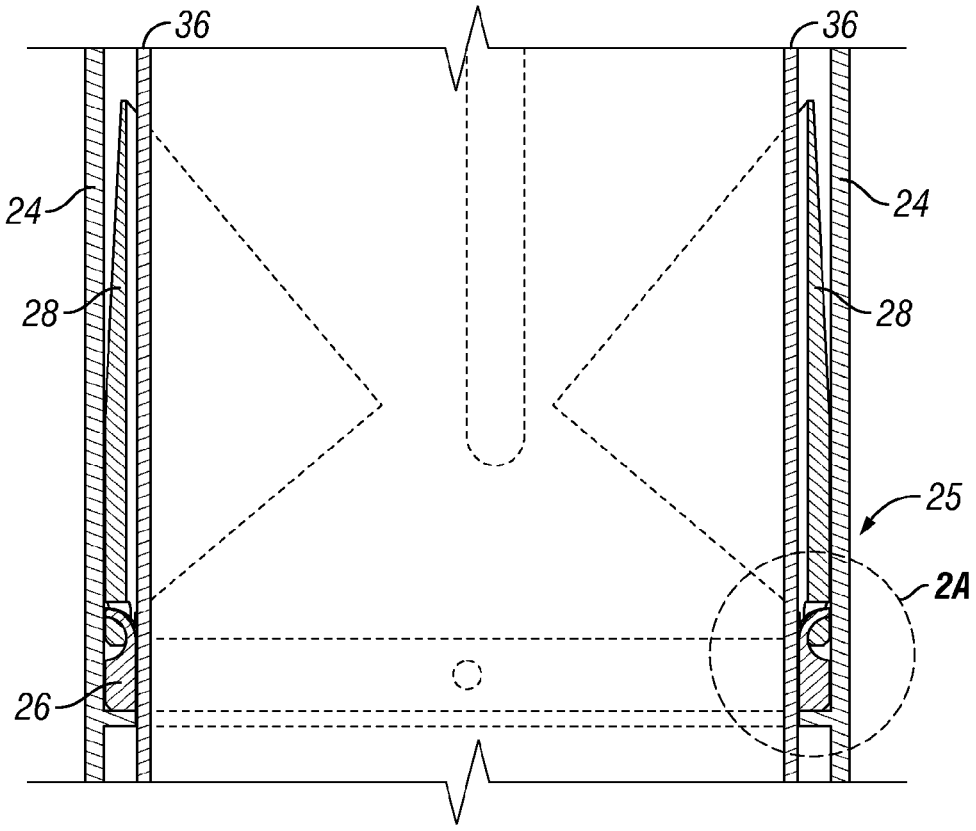
FIG. 2 is a partial sectional view of a core catcher in an open position.
Figure 2A:
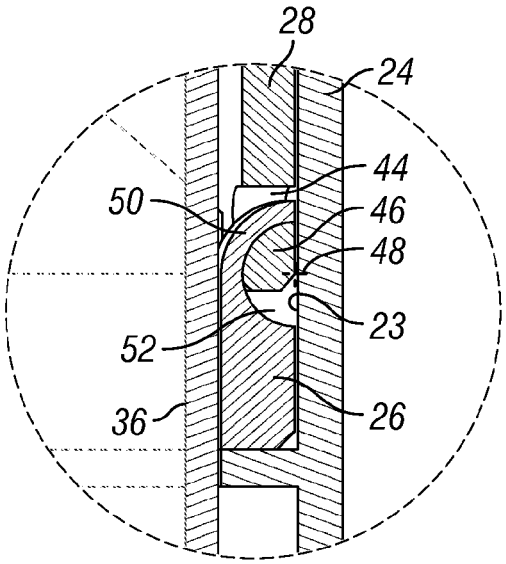
FIG. 2A is a detail sectional view of a portion of the core catcher shown in FIG. 3.

The primary core catcher mechanism 25 is disposed within the lower housing 24 and includes one or more closure members 28 that are rotatably coupled to a retention member 26. As shown in FIGS. 2 and 2A, the retention member 26 includes one or more hinge tabs 50 that form a hinge barrel 52 with the inner wall 23 of the lower housing 24. Each hinge tab 50 is inserted into a slot 44 through a closure member 28. One edge of the slot 44 includes a curved pivot edge 46 that can slide along the curved surface of the hinge tab 50. The interface of the hinge tab 50 and the slot 44 creates a pivot axis 48 that can be located at a maximum distance from the centerline of the axial bore 21. In certain embodiments, the pivot axis 48 can be substantially tangent to the inner surface of the lower housing 24.

Referring back to FIG. 1, a cam ring 32 is disposed within the lower housing 24 and is biased into contact with an upper edge of the closure members 28 by a spring 32, which is held in compression by the upper housing 30. As will be discussed in detail to follow, upon actuation of the core catcher assembly 20, the spring 32 urges the cam ring 32 downward, which causes the closure members 28 to rotate inward towards a closed position.

Figure 3:
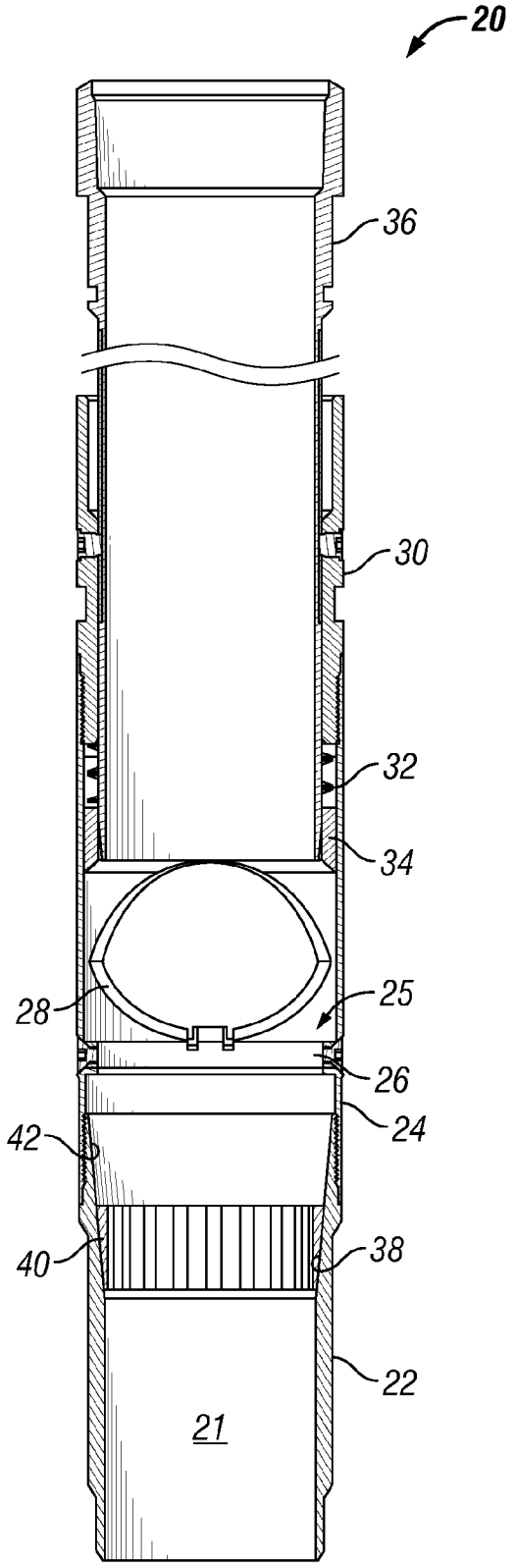
FIG. 3 is a partial sectional view of a core catcher assembly.

FIG. 1 illustrates the core catcher assembly 20 with the inner sleeve 36 in a first position that provides a continuous surface to allow the core drilled by coring bit 12 to easily travel through the core catcher assembly 20 and into the inner barrel 19. In the first position, the inner sleeve 36 extends through the body of the core catcher assembly 20 from the upper housing 30 into the inner shoe 22. The secondary core catcher 38 is disposed in an annulus formed between the inner sleeve 36 and the inner shoe 22. As shown in FIGS. 3 and 3A, the closure members 28 are held in an open position where they are retained in an annulus formed between the lower housing 24 and the inner sleeve 36.

FIG. 3 illustrates the core catcher assembly 20 in a second position where the inner sleeve 36 has moved to a position where the closure members 28 are released but have not yet closed. As the inner sleeve 36 moves, the secondary core catcher 38 is released and can move inward to engage the core. The secondary core catcher 38 can be a spring-loaded core catcher that, once released, will engage the core. The secondary core catcher 38 has a frustoconical outer surface 40 that engages a complimentary surface 42 on the inner shoe 22. Once the secondary core catcher 38 is engaged with the core, if the core moves downward relative to the inner shoe 22, the secondary core catcher 38 will be compressed between the core and the inner shoe 22 and act to wedge the core in place.

Figure 4:
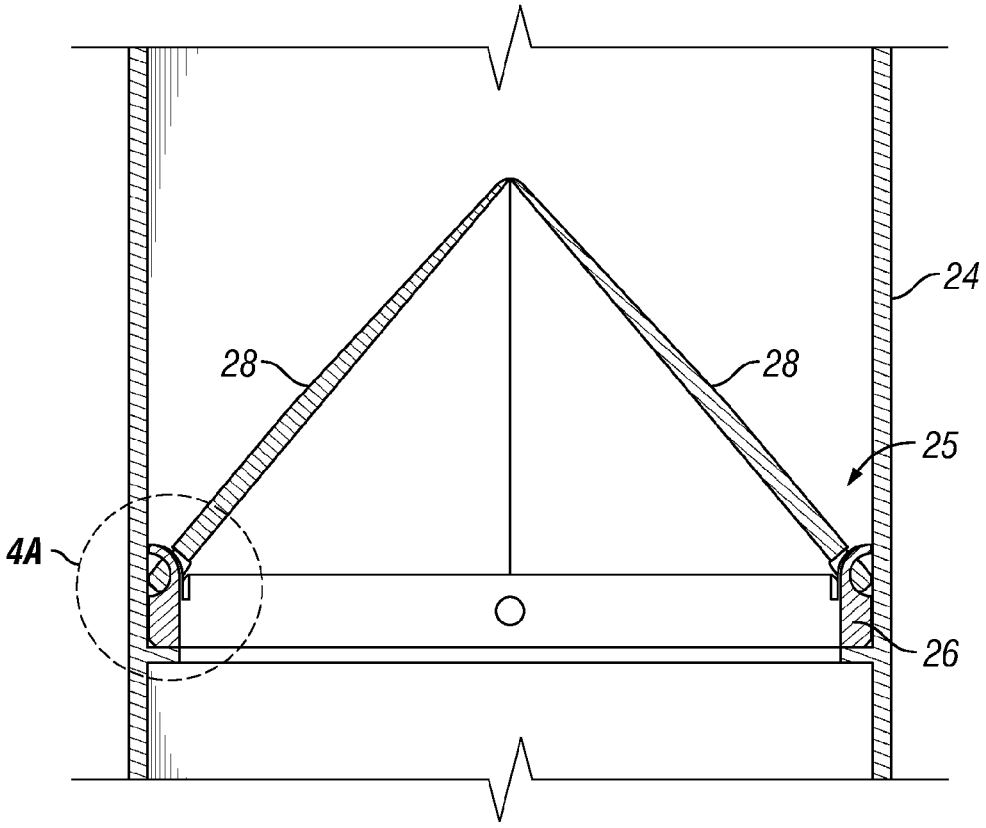
FIG. 4 is a partial sectional view of a core catcher in a closed position.
Figure 4A:
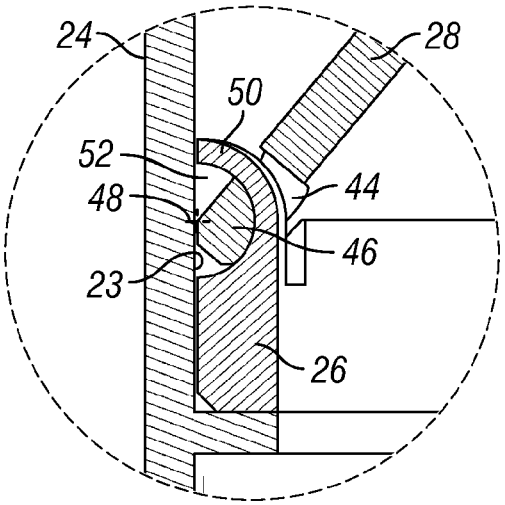
FIG. 4A is a detail sectional view of a portion of the core catcher shown in FIG. 4.

After releasing the secondary core catcher 38, the inner sleeve 36 continues to move and releases the closure member 28 from the annulus between the inner sleeve 36 and the lower housing 24. Once released, the closure members 28 are free to rotate to a closed position, as is shown in FIGS. 4 and 4A. As the closure members 28 rotate, the cam ring 34 is moved downward by the compressive force of spring 32. The movement of the cam ring 34 rotates the closure members 28 so that pivot edge 46 moves along the curved surface of hinge tab 50 and the closure members 28 rotate about the pivot axis 48. The closure members 28 can continue to rotate until they reach a closed position where the closure members 28 contact each other and the retention member 26.

In the case of a solid rock core, the closure members 28 will bear against the rock core, and may not completely close. However, in the case where the core is sandy, loose, unconsolidated or highly fragmented, the closure members 28 can be driven entirely or at least partially into the core, thereby entirely or partially closing the axial bore through the lower housing 24. If the closure members 28 only partially close, the spring 32 and the cam ring 34 cause the closure members 28 to continue to bear on the core and to close later if the core crumbles.

Figure 5:
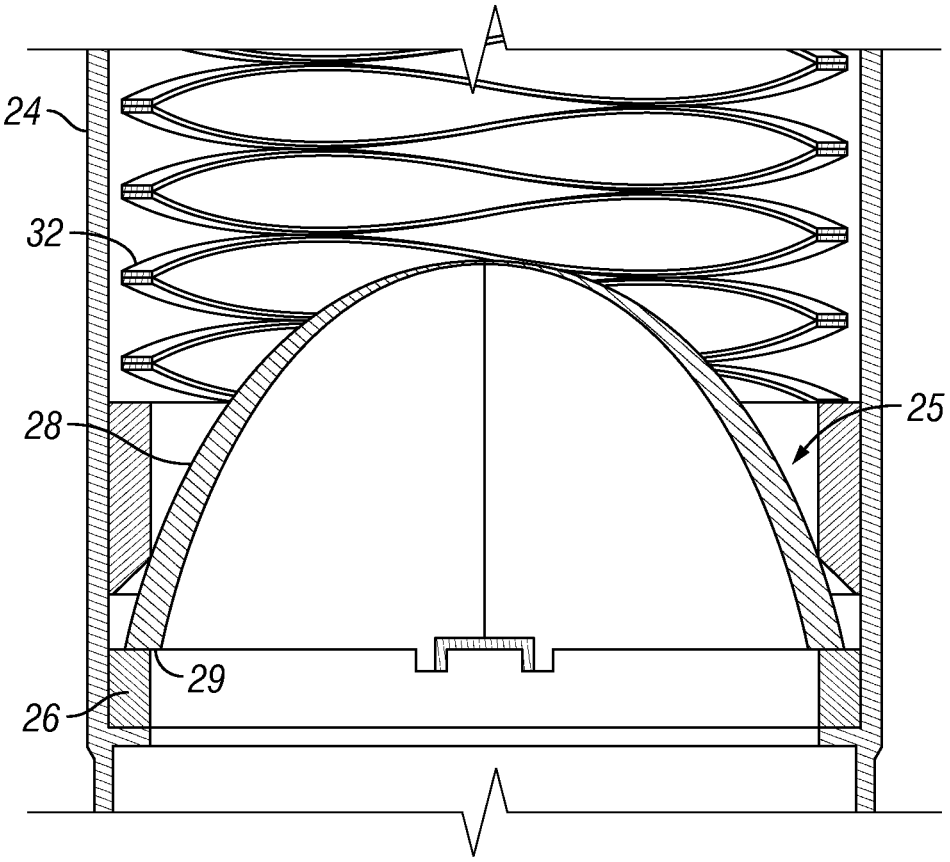
FIG. 5 is a partial sectional view of a core catcher in a closed position.

As is shown in FIG. 5, the entire edge 29 of the closure member 28 is in contact with the retention member 26. This full contact between the closure member 28 and the retention member 26 is possible due to the pivot axis 48 being at a sufficient distance from the center of the lower housing 24. In some embodiments, the pivot axis 48 is substantially tangent to the inner diameter of the lower housing 24. Being in full contact with the retention ring 26 allows the closure member 28 to be fully supported, thereby increasing the strength of the closure member 28. The full contact between the retention ring 26 and the closure member 28 also helps prevent the loss of any unconsolidated formation material, such as gravel or sand, across the interface between the closure member 28 and the retention ring 26.

Figure 6:
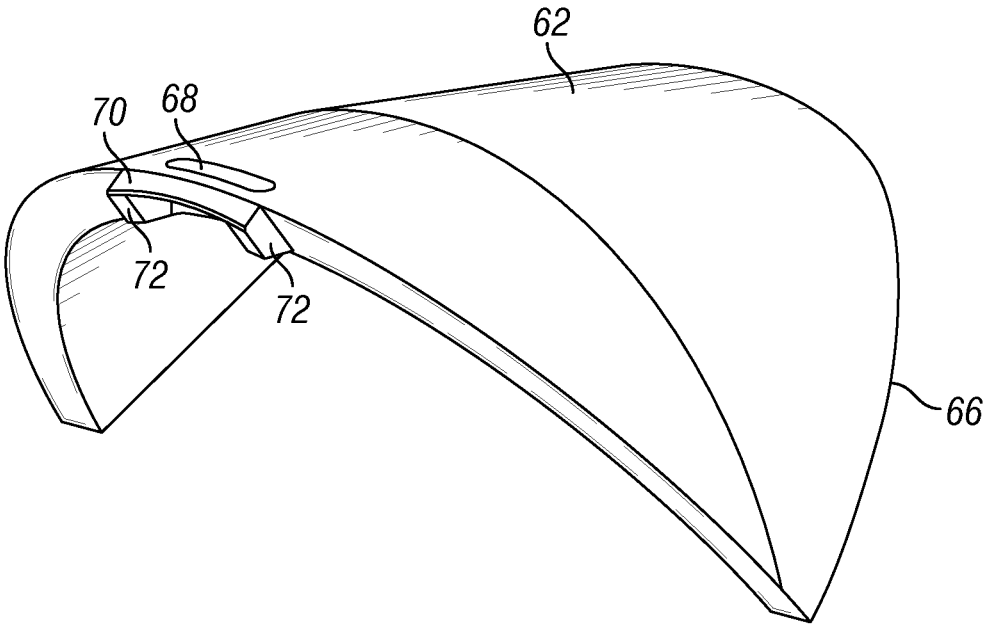
FIG. 6 is a view of a clamshell closure member.
Figure 7:
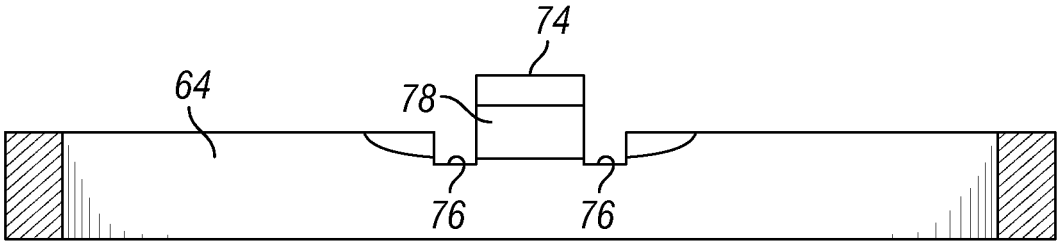
FIG. 7 is a sectional view of a retention ring used in conjunction with the clamshell closure member of FIG. 6.
Figure 8:
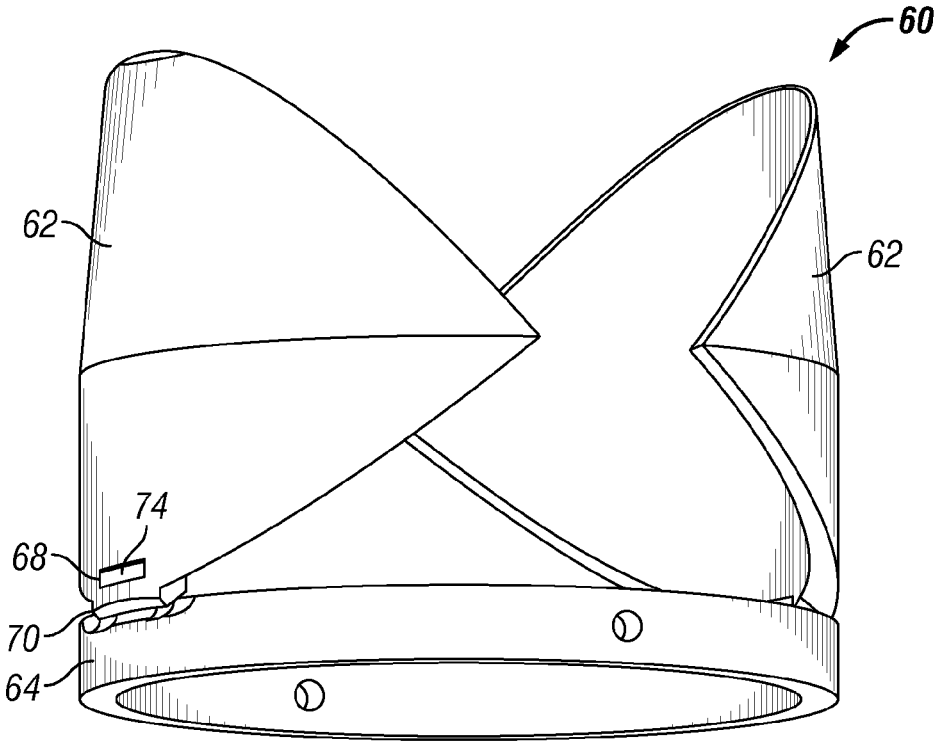
FIG. 8 is a view of a clamshell core catcher in an open position.
Figure 9:
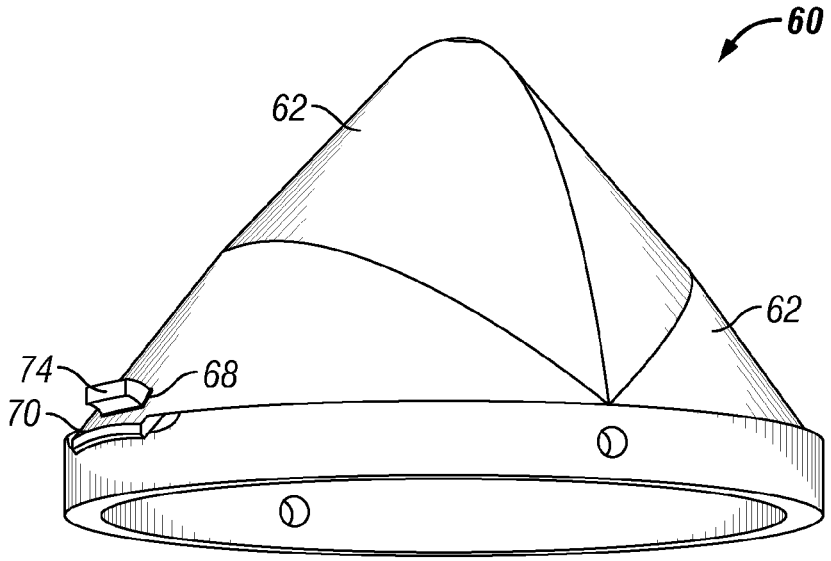
FIG. 9 is a view of the clamshell core catcher of FIG. 8 in a closed position.

FIGS. 6-9 illustrate an exemplary clamshell core catcher assembly 60 including a pair of clamshell members 62 coupled to a retention ring 64. Although the embodiments discussed and described herein are illustrated as having two opposed closure members, alternate systems may use a single closure member or a plurality of closure members. Referring now to FIG. 6, each clamshell member 62 includes a curved body 66 having a slot 68. One edge of the slot 68 defines a pivot edge 70 that has an alignment tab 72 disposed on each end. Referring now to FIG. 7, retention ring 64 includes a pair of pivot tabs 74 that engage the slots 68. The pivot tabs 74 have a curved inner surface 78 that engages the pivot edge 70 of the clamshell members 62. The retention ring 64 also includes alignment slots 76 on either end of the pivot tabs 74 that engage the alignment tabs 72 and help maintain alignment of the clamshell member 62 relative to the retention ring 64 as the clamshell members 62 rotate from the open position shown in FIG. 8 to the closed position shown in FIG. 9.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. A core catcher comprising:

a housing having an inner wall defining an axial bore through the housing;

a retention member disposed within the housing;

a first hinge tab coupled to the retention member;

a first hinge barrel defined by the first hinge tab and the inner wall of the housing;

a first closure member having a slot that is engaged with the first hinge tab and a pivot edge at least partially disposed within the first hinge barrel; and a sleeve slidably disposed within the housing, wherein the first closure member has an open position where the first closure member is disposed in an annulus between the sleeve and the housing, and a closed position where the first closure member is disposed at least partially across the axial bore of the housing.

2. The core catcher of claim 1, wherein the first closure member is fully supported by the retention member when in the closed position.

3. The core catcher of claim 1, wherein the first closure member rotates about a first pivot axis as it rotates from the open position to the closed position.

4. The core catcher of claim 3, wherein the first pivot axis is substantially tangent with the inner wall of the housing.

5. The core catcher of claim 1, further comprising:

a cam ring disposed within the housing; and a spring disposed within the housing and operable to urge the cam ring into contact with the first closure member so as to rotate the closure member about the first pivot axis.

6. The core catcher of claim 1, further comprising:

a second hinge tab coupled to the retention member;

a second hinge barrel defined by the second hinge tab and the inner wall of the housing; and a second closure member having a slot that is engaged with the second hinge tab and a pivot edge at least partially disposed within the second hinge barrel.

7. The core catcher of claim 6, wherein in the closed position the first closure member contacts the second closure member.

8. The core catcher of claim 1, further comprising:

an alignment tab extending from the first closure member proximate to the pivot edge; and an alignment slot formed in the retention member proximate to the first hinge tab and operable to engage the alignment tab.

9. A coring tool comprising:

a coring bit coupled to an outer barrel;

an inner barrel disposed at least partially within the outer barrel;

a core catcher body coupled to the inner barrel and at least partially disposed within the coring bit, wherein the core catcher body has an inner wall that defines an axial bore that is substantially aligned with a center axis the inner barrel;

a retention member disposed within the core catcher body, wherein the retention member includes a first hinge tab disposed proximate to the inner wall of the core catcher body so as to define a first hinge barrel formed by the first hinge tab and the inner wall of the core catcher body;

a first closure member having a slot that is engaged with the first hinge tab and a pivot edge at least partially disposed within the first hinge barrel, wherein the first closure member is rotatable from an open position to a closed position about a first pivot axis; and a sleeve disposed within the core catcher body and moveable between a first position, wherein the first closure member is disposed in the open position in an annulus between the sleeve and the housing, and a second position, wherein the first closure member is free to rotate to the closed position.

10. The coring tool of claim 9, wherein the first closure member is positioned at least partially across the axial bore when the first closure member is in the closed position.

11. The coring tool of claim 10, wherein the first closure member is fully supported by the retention member when the first closure member is in the closed position.

12. The coring tool of claim 9, wherein the first pivot axis is substantially tangent with the inner wall of the housing.

13. The coring tool of claim 9, further comprising:

a cam ring disposed within the housing; and a spring disposed within the housing and operable to urge the cam ring into contact with the first closure member so as to rotate the closure member about the first pivot axis.

14. The coring tool of claim 9, further comprising:

a second hinge tab coupled to the retention member;

a second hinge barrel defined by the second hinge tab and the inner wall of the core catcher body; and a second closure member having a slot that is engaged with the second hinge tab and a pivot edge at least partially disposed within the second hinge barrel.

15. The coring tool of claim 14, wherein in the first closure member contacts the second closure member in the closed position.

16. The coring tool of claim 9, further comprising a secondary core catcher disposed within the core catcher body, wherein the secondary core catcher has a first position disposed within an annulus between the sleeve and the core catcher body.

17. The coring tool of claim 9, further comprising:

an alignment tab extending from the first closure member proximate to the pivot edge; and an alignment slot formed in the retention member proximate to the first hinge tab and operable to engage the alignment tab.

18. A method for retaining a core in a core barrel, the method comprising:

rotatably coupling a closure member to a retention member by engaging a slot through the closure member with a hinge tab that is coupled to the retention member, wherein the retention member is disposed within a housing so that the hinge tab forms a hinge barrel with a wall of the housing;

retaining the closure member in an open position within an annulus between a sleeve and the housing;

moving a core longitudinally through the sleeve and into a core barrel that is coupled to the housing;

translating the sleeve relative to the housing so as to release the closure member; and rotating the closure member about a pivot axis to a closed position wherein the closure member restricts movement of the core relative to the core barrel.

19. The method of claim 18, wherein the pivot axis is substantially tangent to the wall of the housing.

20. The method of claim 18, wherein in the closed position the closure member is fully supported by the retention member.

21. The method of claim 18, wherein the closure member is rotated from the open position to the closed position by urging a cam ring into contact with the closure member.

22. The method of claim 18, further comprising deploying a secondary core catcher from a first position disposed within an annulus between the sleeve and the housing to a second position engaged with the core.

23. The method of claim 18, further comprising:

aligning the closure member and the retention member by engaging an alignment slot that is formed in the retention member proximate to the first hinge tab with an alignment tab that extends from the first closure member.

* * * * *